US007657216B2

(12) United States Patent
Lee et al.

(10) Patent No.: US 7,657,216 B2
(45) Date of Patent: Feb. 2, 2010

(54) FIXING UNIT AND IMAGE FORMING APPARATUS HAVING THE SAME

(75) Inventors: Seung-jun Lee, Suwon-si (KR); Hwan-guem Kim, Seoul (KR); Dong-jin Seol, Suwon-si (KR); Dong-woo Lee, Seoul (KR); Tae-gyu Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 161 days.

(21) Appl. No.: 11/854,645

(22) Filed: Sep. 13, 2007

(65) Prior Publication Data

US 2008/0240806 A1 Oct. 2, 2008

(30) Foreign Application Priority Data

Mar. 27, 2007 (KR) ..... 10-2007-0029741

(51) Int. Cl.
*G03G 15/20* (2006.01)

(52) U.S. Cl. ..... 399/328; 399/329

(58) Field of Classification Search ..... 399/328, 399/329, 330, 67; 219/216; 347/156
See application file for complete search history.

(56) References Cited

U.S. PATENT DOCUMENTS

| | | | | |
|---|---|---|---|---|
| 6,049,691 | A * | 4/2000 | Abe et al. | 399/330 |
| 2005/0185996 | A1* | 8/2005 | Oishi et al. | 399/329 |
| 2006/0153605 | A1* | 7/2006 | Nishiyama et al. | 399/329 |
| 2008/0050155 | A1* | 2/2008 | Miki et al. | 399/328 |
| 2008/0063442 | A1* | 3/2008 | Yagi et al. | 399/328 |

* cited by examiner

*Primary Examiner*—Sophia S Chen
(74) *Attorney, Agent, or Firm*—Stein McEwen, LLP

(57) ABSTRACT

A fixing unit which enables high-speed operation and miniaturization, and an image forming apparatus having the fixing unit, includes a heating member which is heated by a heat source, the heating member having a predetermined width; a rotating member to rotate in contact with the heating member; a driving member to rotate the rotating member; and a pressing member to press both sides of the heating member towards the driving member and to form a predetermined fixing nip between the rotating member and the driving member, wherein the heating member has a second moment of inertia which is set to maintain a fixing efficiency of 90% or more in a central portion of the heating member.

29 Claims, 7 Drawing Sheets

150° C ⟶ 2.4s 62.5° C /s

FIXING UNIT AND IMAGE FORMING APPARATUS HAVING THE SAME

CROSS-REFERENCE TO RELATED APPLICATIONS

This application claims the benefit of Korean Application No. 2007-29741, filed Mar. 27, 2007, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to a fixing unit to fix an image transferred to a printing medium and an image forming apparatus having the fixing unit.

2. Description of the Related Art

In general, image forming apparatuses, such as copiers, printers, facsimile machines, and multi-function machines embodying the functions of the above-mentioned devices in a single device, comprise photosensitive members on which electrostatic latent images are formed, developing units to develop the electrostatic latent images, transferring units to transfer the developed images onto printing media, and fixing units to fix the transferred images onto the printing media. FIG. 1 shows an example of a fixing unit.

The fixing unit of a conventional image forming apparatus illustrated in FIG. 1 includes a heating roller 1 and a pressing roller 2 which rotate and contact with each other. A heat source 1*a* is mounted within the heating roller 1, and the pressing roller 2 is biased toward the heating roller 1 by a pressing spring (not illustrated). In the heating and pressing rollers 1 and 2, an elastic rubber layer 1*c* and a release layer 2*c* are laminated on outer surfaces of metal pipes 1*b* and 2*b*, respectively.

In the configuration described above, a printing medium P to which an image is transferred passes through a fixing nip N between the heating and pressing rollers 1 and 2, and accordingly, heat and pressure are applied to the image on the printing medium P such that the image is fixed to the printing medium.

In order to decrease fixing time to achieve high-speed printing, outer diameters of the heating and pressing rollers 1 and 2 may be expanded or the thickness of the elastic rubber layer may be thickened. Accordingly, there is provided a method for shortening the fixing time by increasing the size of the fixing nip N.

However, if the outer diameters of the heating and pressing rollers 1 and 2 are increased, the entire volume of the image forming apparatus will also increase as well as the warm-up time, causing an increase in cost. Additionally, if the elastic rubber layer is thickened, the warm-up time may further increase, the fixing efficiency may deteriorate, and the durability may be reduced due to a concomitant increase in the fixing temperature.

Fixing efficiency may be enhanced by increasing the pressurizing force of the pressing roller 2, but other problems arise, such as distortion of the elastic rubber layer, a decrease in durability, jamming caused by a decrease in the transferring force of the printing medium P, and a necessary increase in driving torque.

SUMMARY OF THE INVENTION

Aspects of the present invention relate to a fixing unit which enables high-speed operation and miniaturization and an image forming apparatus having the fixing unit.

According to an aspect of the present invention, there is provided a fixing unit including a heating member which is heated by a heat source, the heating member having a predetermined width; a rotating member to rotate in contact with and about the heating member; a driving member to rotate the rotating member; and a pressing member to press both sides of the heating member towards the driving member and to form a predetermined fixing nip between the rotating member and the driving member, wherein the heating member has a second moment of inertia which is set to maintain a fixing efficiency of 90% or more in a central portion of the heating member relative to the sides of the heating member.

According to an aspect of the present invention, the second moment of inertia may satisfy the following Equation:

$$Ix \geqq 0.052(FL^3)/E \qquad \text{[Equation]}$$

wherein Ix represents the second moment of inertia of the heating member; F represents the pressurizing force of the pressing member; L represents an axial direction length of the heating member; and E represents the Young's modulus of the heating member.

According to an aspect of the present invention, a nip surface of the heating member disposed to face the driving member may be bent to form a predetermined curvature. The fixing unit may further include a compensating member to prevent damage of the heat member from stress associated with heat transfer from the heat source; and a preventing member, disposed between the compensating member and the heating member, to prevent heat transfer between the heating member and the compensating member.

According to an aspect of the present invention, the fixing unit may include a rotation guide member disposed to guide the rotation of the rotating member about the heating member and through the predetermined fixing nip. The heat source may contact the heating member. An elastic member to elastically press the heat source towards the heating member may be disposed between the heat source and the preventing member. A thermal conductive resin may be disposed between the heat source and the heating member. The heat source may be spaced apart from the heating member by a predetermined distance. An inner surface of the heating member facing the heating source may be black.

According to another aspect of the present invention, there is provided a fixing unit including a heating member which is heated by a heat source, the heating member having a predetermined width; a rotating member to rotate in contact with and about the heating member; a driving member to rotate the rotating member; and a pressing member to press both sides of the heating member towards the driving member and to form a predetermined fixing nip between the rotating member and the driving member, wherein the maximum deflection of a central portion of the heating member is less than approximately 0.5 mm.

According to another aspect of the present invention, there is provided an image forming apparatus including a main body; at least one photosensitive member on which an electrostatic latent image is formed; at least one developing unit to develop the electrostatic latent image; at least one transferring unit to transfer the developed image to a printing medium; and a fixing unit to fix the transferred image onto the printing medium. The fixing unit may include a heating member which is heated by a heat source, the heating member having a predetermined width and a second moment of inertia to maintain a fixing efficiency of 90% or more in a central portion of the heating member relative to both sides of the heating member; a rotating member to rotate in contact with and about the heating member; a driving member to rotate the rotating member; and a pressing member to press both sides of the heating member towards the driving member and form a predetermined fixing nip between the rotating member and the driving member.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
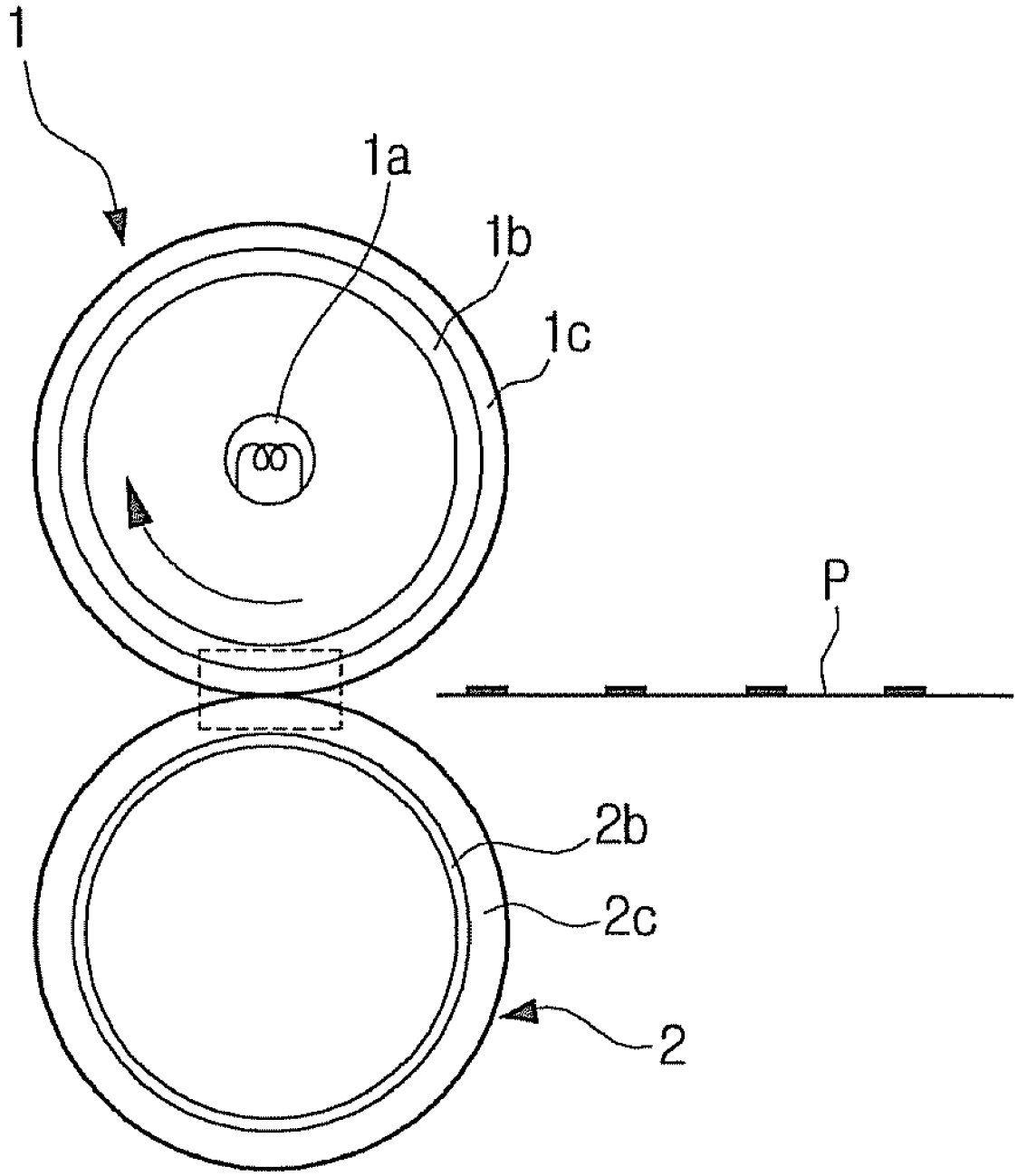
FIG. 1 (PRIOR ART)
FIG. 1 is a sectional view schematically illustrating a fixing unit of a conventional image forming apparatus.

Reference will now be made in detail to aspects of the present invention, examples of which are illustrated in the accompanying drawings, wherein like reference numerals refer to the like elements throughout. Aspects are described below in order to explain the present invention with reference to the figures.

Figure 2:
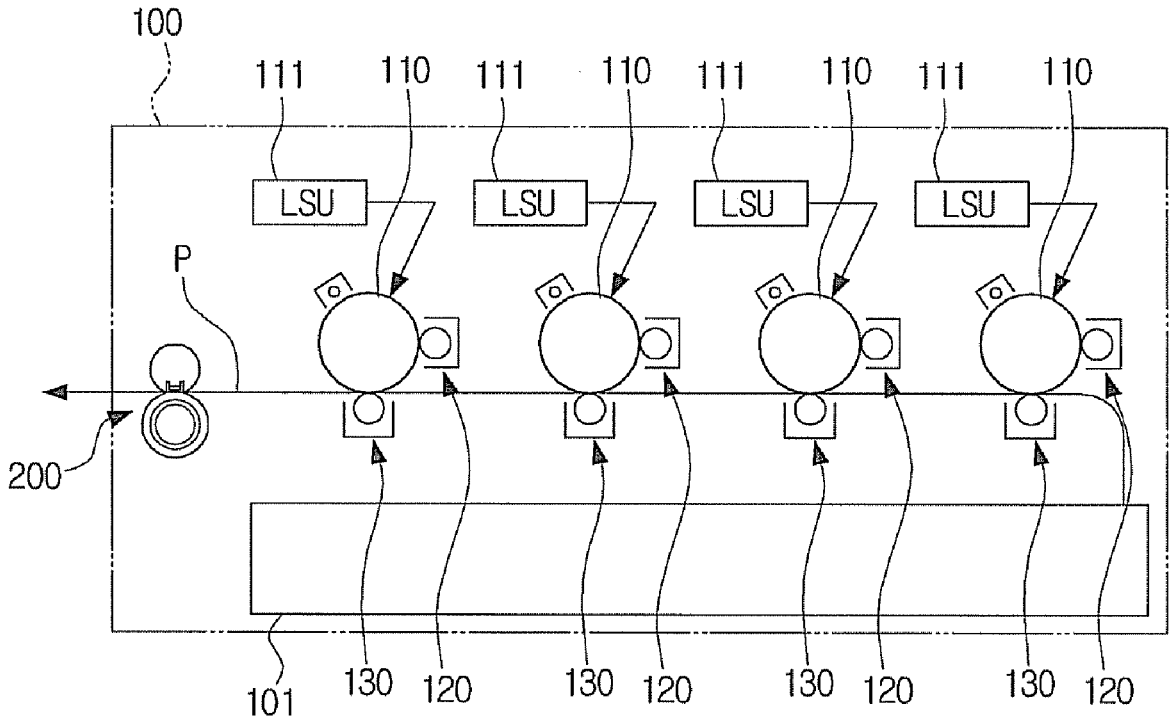
FIG. 2 is a view schematically illustrating a configuration of an image forming apparatus according to aspects of the present invention.

Hereinafter, a fixing unit and an image forming apparatus having the fixing unit according to an aspect of the present invention will be described in detail with reference to the accompanying drawings. Referring to FIG. 2, an image forming apparatus according to an aspect of the present invention comprises a photosensitive member 110, a developing unit 120, a transferring unit 130 and a fixing unit 200, which are mounted inside a main body 100 of the image forming apparatus.

A surface of the photosensitive member 110 is exposed by an exposure unit 111 to form a predetermined potential, and an electrostatic latent image is then formed. The developing unit 120 develops the electrostatic latent image on the photosensitive member 110 using a developer.

According to aspects of the present invention, four photosensitive members 110 and four developing units 120 are provided so that electrostatic latent images corresponding respectively to images of a plurality of colors, such as cyan (C), magenta (M), yellow (Y) and black (K), can be formed and developed. However, the image forming apparatus is not limited thereto such that the photosensitive members 110 and the developing units 120 may be arranged to deliver any number of colors. Further, images of a plurality of colors may be superimposed and developed on a single photosensitive member 110 by a plurality of developing units 120.

The transferring unit 130 transfers an image developed on the photosensitive member 110 to a printing medium P. The transferring unit 130 comprises a roller which rotates facing the photosensitive member 110. Accordingly, the printing medium P is passed between the photosensitive member 110 and the transferring unit 130 both of which rotate while facing each other, and the image developed on the photosensitive member 110 is then transferred to the printing medium P. The printing medium P is picked up and fed to travel between the photosensitive members 110 and the transferring units 130 sheet by sheet from a paper cassette 101 (not shown), which is detachably mounted on the main body 100 of the image forming apparatus.

Figure 3:
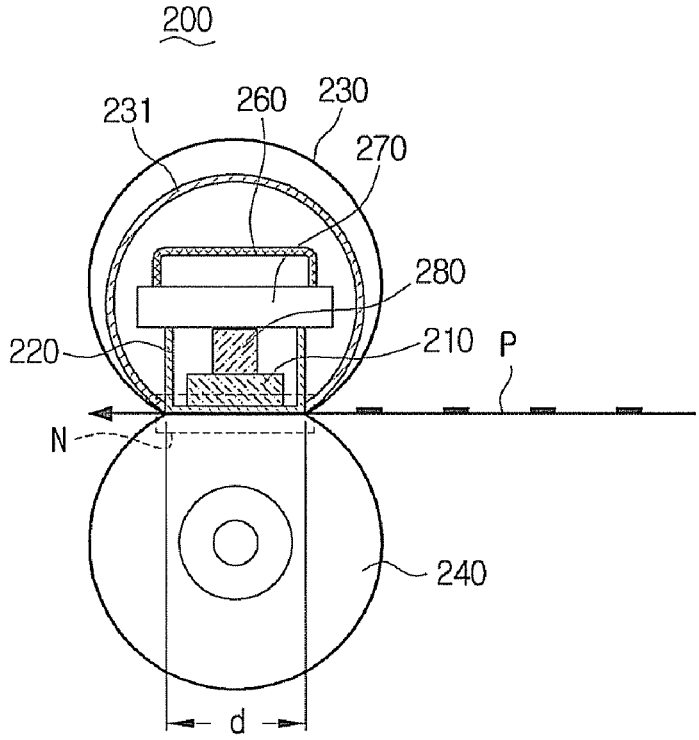
FIG. 3 is a sectional view schematically illustrating a fixing unit of the image forming apparatus of FIG. 2.

The configuration of the fixing unit 200 will now be described in detail below. The fixing unit 200 fixes the transferred image onto the printing medium P by applying heat and pressure. As illustrated in FIG. 3, the fixing unit 200 comprises a heat source 210, a heating member 220, a rotating member 230, a driving member 240, and a pressing member 250.

The heat source 210 generates and applies a fixing heat to the image transferred to the printing medium P. The heat source 210 may be a heating device such as a halogen lamp, a resistive heating element, or other heating device. A halogen lamp may be used as the heat source 210.

The fixing heat from the heat source 210 is applied to the heating member 220. Specifically, the heat source 210 is mounted in contact with an inner surface of the heating member 220, and accordingly the fixing heat from the heat source 210 is transferred to the heating member 220 by at least thermal conduction. As such, a thermal conductive resin may be provided in order to improve the thermal conductivity between the heat source 210 and the heating member 220.

The rotating member 230 rotates in contact with an outer surface of the heating member 220. In other words, the heat source 210 is disposed inside the heating member 220 and the rotating member 230 rotates about the outside of the heating member 220 to heat the printing medium P with the fixing heat transferred from the heating member 220, which directly contacts the rotating member 230. The rotating member 230 is provided in the form of a continuously rotating belt. A lubricant such as lubricating oil may be applied to an inner surface of the rotating member 230 so that the rotating member 230 rotates smoothly even when in contact with the heating member 220.

The rotation of the rotating member 230 is guided by a rotation guide member 231 which is mounted inside the rotating member 230. Specifically, the rotation guide member 231 is disposed within the rotating member 230 so that the rotating member 230, which freely rotates, may be guided in its rotation and prevented from meandering.

Although the rotating member 230 configured as described above is not illustrated in detail, a base layer formed of a high molecular weight material such as polyetheretherketone (PEEK), or a base layer formed of a metallic material such as nickel (Ni), Ni alloy, copper (Cu), or Cu alloy may be formed on the rotating member 230. Additionally, an elastic layer and a release layer may be formed on an outer surface of the base layers in order to increase the fixing efficiency.

According to the configuration described above, the fixing heat generated from the heat source 210 is transmitted to the heating member 220 and the rotating member 230 to heat the image on the printing medium P. As the rotating member 230 rotates about the heating member 220 and the heat source 210, the rotating member 230 is heated, which in turn heats the image on the printing medium P so as to transfer the image thereto.

The driving member 240, which faces the heating member 220, rotates in contact with the rotating member 230 and facilitates the rotation of the rotating member 230. In other words, the rotating member 230 is rotated freely by a driving force exerted by the driving member 240 while in contact with the driving member 240. A fixing nip N is formed between the rotating member 230 and the driving member 240, and the printing medium P passes through the fixing nip N. The area of the fixing nip N is substantially equal to the area of a region in which the heating member 220 and the driving member 240 contact each other and is the path through which the printing medium P travels so as to have a transferred image affixed thereto. Further, the fixing nip N has a predetermined width d, which is the distance through which the printing medium P travels in contact with the rotating member 230 and the driving member 240. If heat from the heating member 220 is not transmitted to the region in which the rotating member 230 and the driving member 240 contact each other, the rotating member 230 and the driving member 240 may only pass over the printing medium P due to the rotation force exerted by the contact region therebetween, and not perform the fixing function.

The driving member 240 has a roller shape and comprises a core pipe, which is formed of one selected from among a metallic material such as steel, stainless steel, aluminum (Al), and Cu, an alloy material, a ceramic material, or a fiber-reinforced material (FRM), and an elastic layer, and a release layer, which are laminated on an outer surface of the core pipe. The elastic layer and release layer of the driving member 240 may be formed of a material such as silicone rubber or fluorine rubber.

The fixing unit 200 according to the aspects of the present invention further comprises a compensating member 260 to support the heating member 220 pressurized by the pressing member 250, and a preventing member 270 which is mounted between the compensating member 260 and the heating member 220.

The compensating member 260 supports the heating member 220 to prevent the heating member 220 from being bent or damaged due to stress from the heat transmitted from the heat source 210. The compensating member 260 is formed of a metallic material such as steel, stainless steel, Al, Cu, an alloy material, a ceramic material or an FRM, in the same manner as the coil pipe of the driving member 240.

The preventing member 270 prevents the heat conducted from the heat source 210 to the heating member 220 from being transferred to the compensating member 260, which supports the heating member 220. In other words, the preventing member 270 prevents heat loss caused by the transfer of heat from the heating member 220 to areas other than the fixing nip N so that fixing efficiency can be improved. Further, the preventing member 270 prevents heat transfer from the heat source 210 to the compensating member 260.

An elastic member 280 formed of an elastic material, such as a sponge or rubber, is mounted between the preventing member 270 and the heat source 210 to elastically press the heat source 210 towards the heating member 220. In other words, the heat source 210 is in close contact with the inner surface of the heating member 220 due to an elastic pressure exerted by the elastic member 280, and thus the thermal conductivity can be improved.

Although the heat source 210 is mounted in contact with the heating member 220 according to aspects of the present invention, other aspects of the present invention are not necessarily limited to the configuration described above. For example, in FIG. 4, a fixing unit 300 includes a heat source 310 separated from the inside surface of a heating member 320, so that a fixing heat from the heat source 310 may be transferred to the heating member 320 by convection or thermal radiation.

Figure 4:
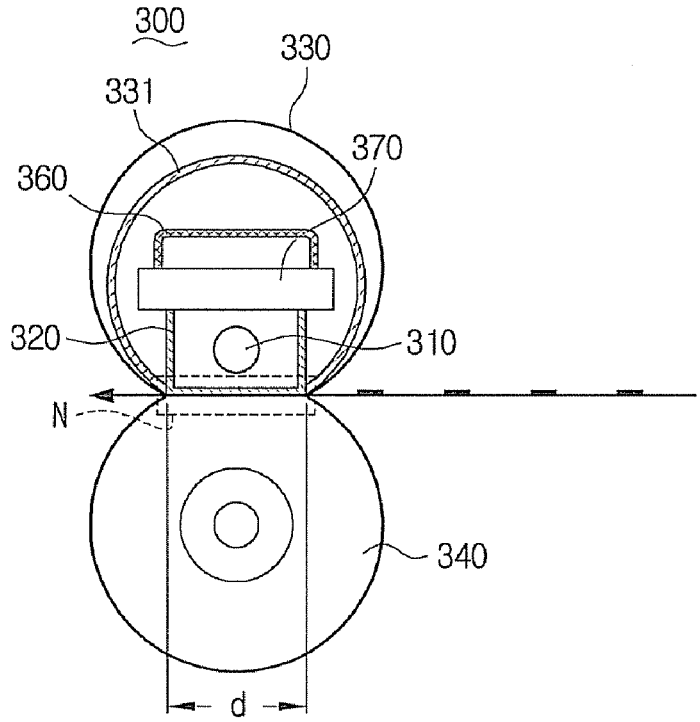
FIG. 4 is a sectional view schematically illustrating a fixing unit of an image forming apparatus according to aspects of the present invention.

Referring to FIG. 4, the heating member 320 is spaced apart from and faces the heat source 310, and the inner surface of the heating member 320 may be coated with black paint or be formed of a black material in order to maximize the radiative efficiency. Since the heat source 310 is spaced apart from the heating member 320 in a manner different from the fixing unit 200 illustrated in FIG. 3, there is no need to mount the elastic member 280 of FIG. 3 which would provide for compression of the heat source 310 to the heating member 320.

Other than the configuration described above, a rotating member 330, a rotation guide member 331, a driving member 340, a pressing member 250, a compensating member 360, and a preventing member 370 of the fixing unit 300 illustrated in FIG. 4 are configured in the same manner as in the fixing unit 200 illustrated in FIG. 3, so further detailed description thereof is omitted.

Figure 6:
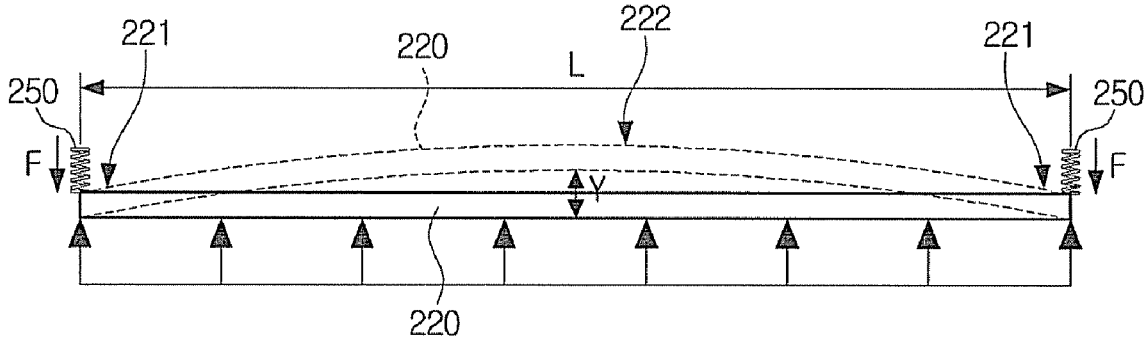
FIG. 6 is a view schematically illustrating the state in which the pressurizing force of a pressing member is applied to a heating member in the fixing unit of FIG. 3.

As illustrated in FIG. 6, a pressing member 250 biases both sides 221 of the heating member 220 (of FIG. 3) towards the driving member 240 (not shown) to form a predetermined fixing nip N. Specifically, the heating member 220 is brought into close contact with the inner surface of the rotating member 230, which rotates in contact with the driving member 240, and thus a wide region in which the rotating member 230 and the driving member 240 contact each other may be formed, and at the same time, heat required to fix an image on the printing medium P may be directly transferred to the region. In this situation, the pressing member 250 biases the sides 221 of the heating member 220 protruding from both sides of the rotating member 230. For this, the axial length L of the pressing member 250 is greater than the axial length of the rotating member 230. The pressurizing force F of the pressing member 250 is in a range that does not interfere with the rotation of the rotating member 230, which is rotated by the driving force of the driving member 240. A biasing device, such as a coil spring, may be used as the pressing member 250. Although FIG. 6 is illustrated including features of the fusing unit 200 of FIG. 3, similar features may be included in the fusing unit 300 of FIG. 4 such that the heating member 320 may be biased by a pressing member 250 exerting a pressurizing force F on both sides 221 of the heating member 320 to form a predetermined fixing nip N.

The heating members 220 and 320 as illustrated in FIGS. 3 and 4 respectively have a plate shape with a predetermined width d defined in a direction perpendicular to the axial direction of the rotating member 230 in order to expand or increase the width of the fixing nip N. The pressing member 250 applies a pressurizing force F only to the sides 221 of the heating member 220, and a central portion 222 of the heating member 220 may be bent as illustrated in FIG. 6. For reference, the heating member 220 is illustrated by solid lines and again by dotted lines in FIG. 6 illustrating the states before and after, respectively, the pressing member 250 bends the heating member 220 to raise the central portion 222 by applying pressure to the sides 221 and from the driving members 240 and 340.

Figure 7:
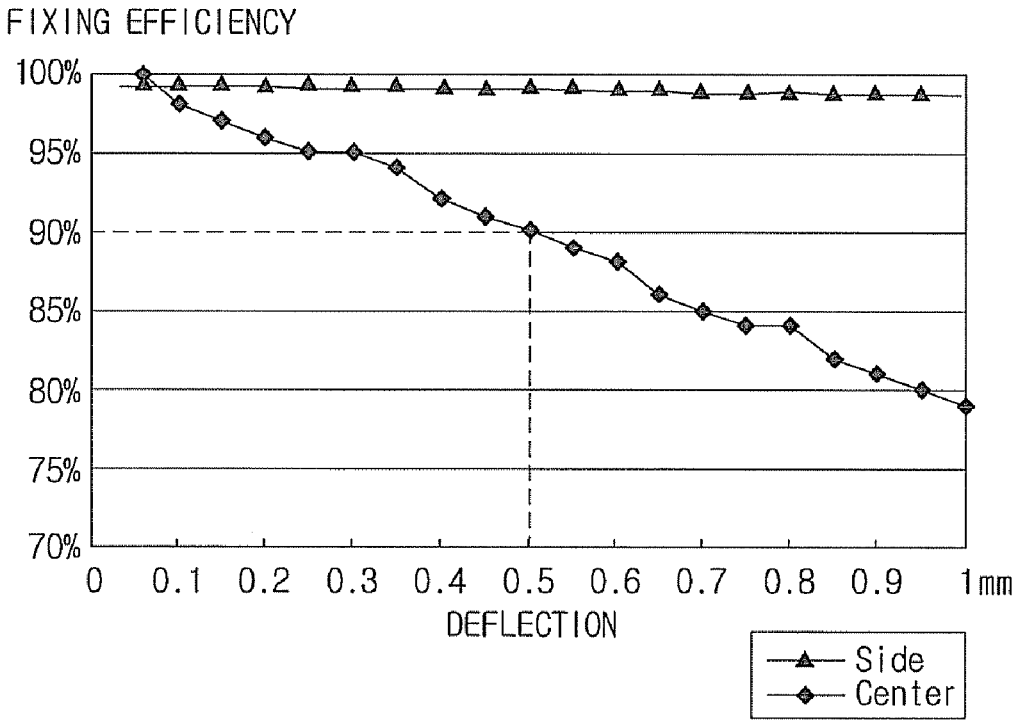
FIG. 7 is a graph schematically illustrating the fixing efficiency according to the deflection of a central portion and both sides of a heating member.

The bending of the central portion 222 of the heating member 220 causes a difference in the fixing efficiency between the sides 221 and the central portion 222 of the heating member 220, as illustrated in a graph of FIG. 7. A desired fixing operation may be performed when the deflection Y of the central portion 222 of the heating member 220 (as shown in FIG. 6) corresponds to a fixing efficiency of greater than approximately 90%. Accordingly, referring to the graph of FIG. 7, the deflection Y of the central portion 222 of the heating member 220 should be less than approximately 0.5 mm, and thus a fixing efficiency of approximately 90% or more can be obtained in the central portion 222 of the heating member 220.

Figure 5A:
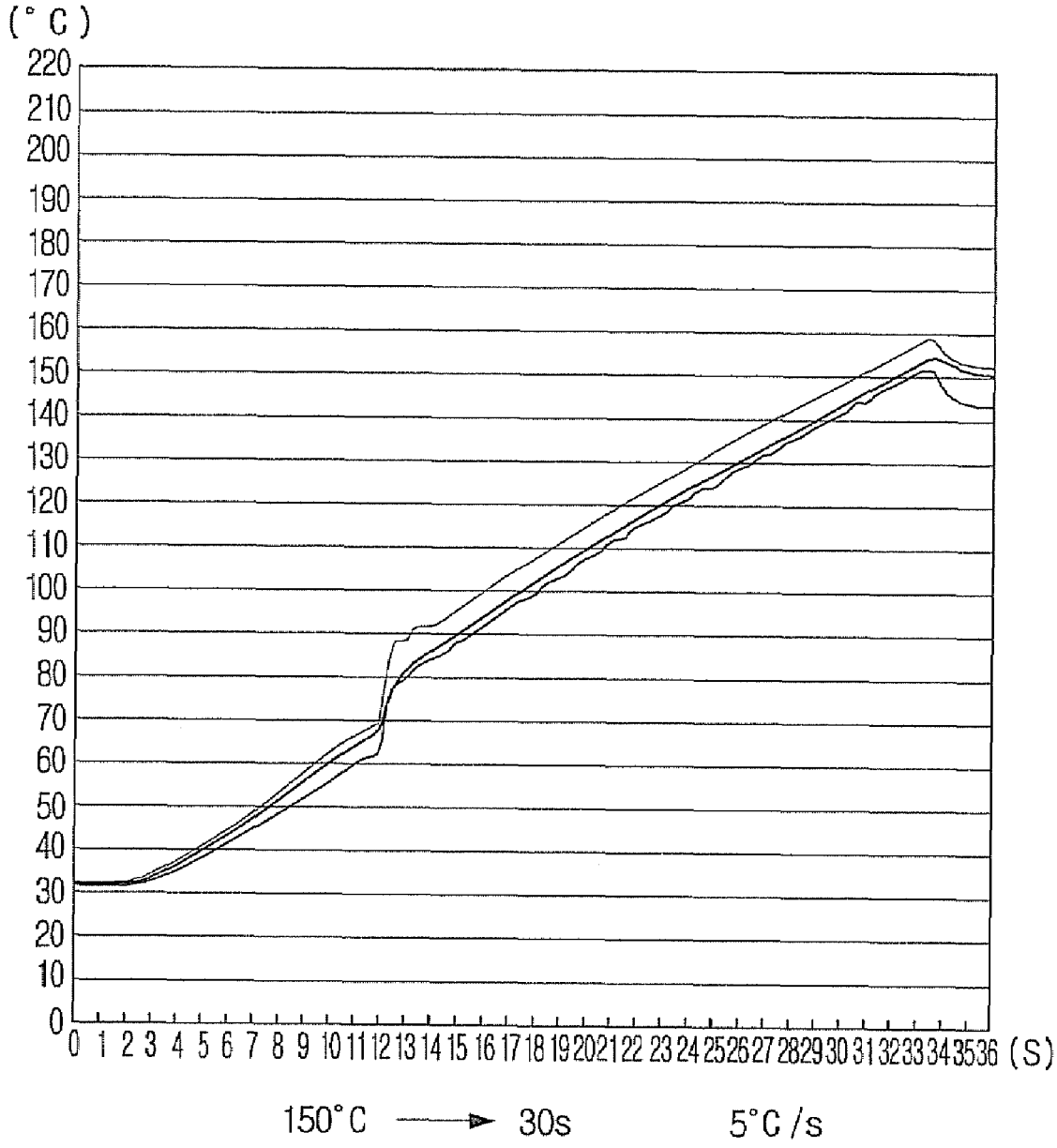
FIGS. 5A to 5C are graphs schematically illustrating temperature change over a period of time in the fixing units illustrated in FIGS. 1, 3 and 4.
Figure 5B:
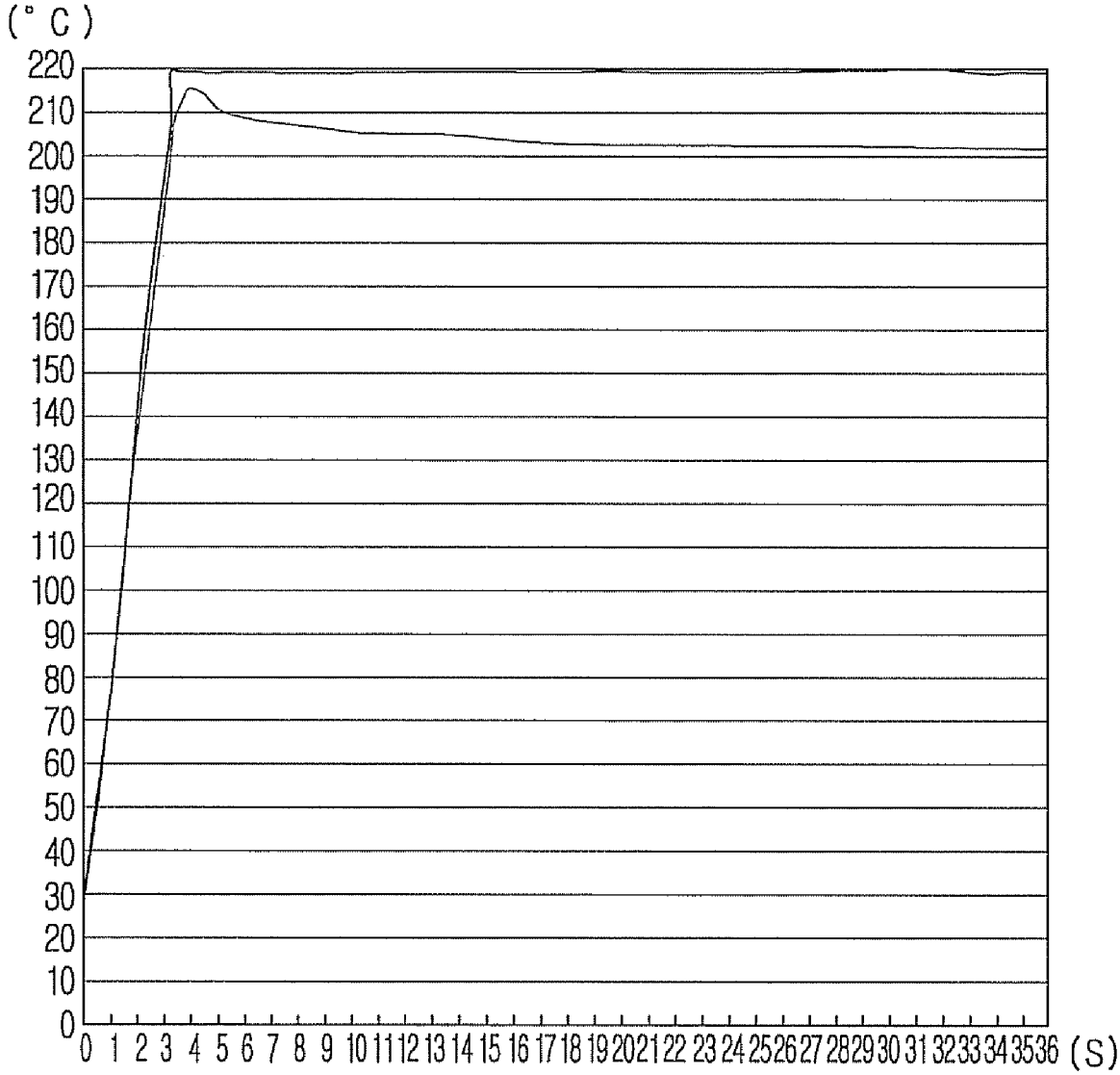
Figure 5C:
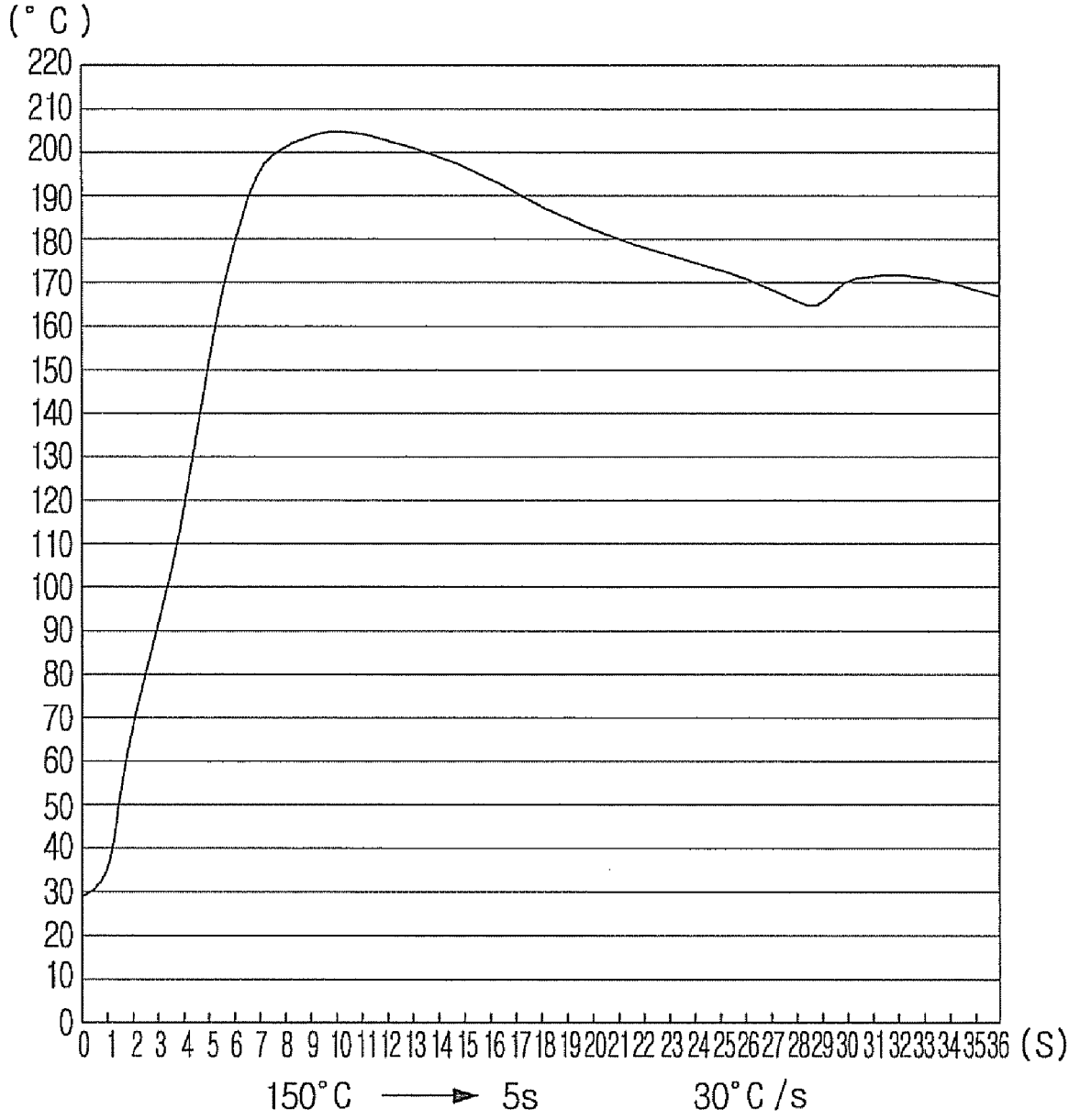

According to the aspects of the current invention, a fixing unit including features as described above demonstrates an increased efficiency compared to the conventional art, as illustrated in FIGS. 5A to 5C. Specifically, as illustrated in FIG. 5A, in the case of the conventional heating and pressing rollers 1 and 2 (of FIG. 1), a period of approximately 30 seconds is required to heat the fixing nip N to approximately 150° C., that is, to a predetermined fixing temperature, and accordingly the heating rate for fixing is approximately 5° C./s.

However, the fixing unit 200 comprising the heating member 220 in contact with the heat source 210, as illustrated in FIG. 3, requires only a period of approximately 2.4 seconds to heat the fixing nip N to approximately 150° C., and accordingly the heating rate for fixing is approximately 62.5° C./s, as illustrated in FIG. 5B. Additionally, the fixing unit 300 of FIG. 4 requires only a period of approximately 5 seconds to heat the fixing nip N to approximately 150° C., and accordingly the heating rate for fixing is approximately 30° C./s, as illustrated in FIG. 5C.

As such, the fixing units 200 and 300 of FIGS. 3 and 4, according to the aspects of the present invention, heat the fixing nip N to the fixing temperature more rapidly than the conventional fixing unit using the heating and pressing rollers 1 and 2, and thus it is possible to perform high-speed printing.

The heating members 220 and 320 as illustrated in FIGS. 3 and 4 respectively have a plate shape with a predetermined width d in a direction perpendicular to the axial direction of the rotating member 230, in order to expand the fixing nip N zones. The pressing member 250 applies the pressurizing force only to the sides 221 of the heating member 220, and accordingly a central portion 222 of the heating member 220 may be bent as illustrated in FIG. 6. (For reference, the heating member 220 is illustrated by a solid line and a dotted line in FIG. 6 according to the state respectively before and after the pressing member 250 bends the central portion 222 of the heating member 220 by applying pressure to the sides 222. The heating member 220 illustrated by the solid line is shown in the state before the central portion 222 of the heating member 220 is bent, and so is made to be in contact with the driving member 240 by the pressing member 250.

The bending of the central portion 222 of the heating member 220 causes a difference in the fixing efficiency between the sides 221 and the central portion 222 of the heating member 220, as illustrated in a graph of FIG. 7. A desired fixing operation may be performed only when the deflection Y of the central portion 222 of the heating member 220 corresponds to a fixing level of less than approximately 90%, relative to the sides 221. Accordingly, referring to the graph of FIG. 7, the deflection Y of the central portion 222 of the heating member 220 should be less than approximately 0.5 mm, and thus a fixing level of approximately 90% or more can be obtained.

The graph of FIG. 7 was obtained by bending the central portion 222 of the heating member 220 in 0.05 mm increments. The heating member 220 tested was made of carbon steel having a Young's modulus E of approximately 207 Gpa, an axial length L of approximately 230 mm; the initial deflection Y of the sides 221 was set to approximately 0.06 mm; and the pressurizing force F of the pressing member 250 was set to approximately 2 kgf. A section of the heating member 220 for which a maximum deflection Ymax of the central portion 222 was measured had a width of approximately 8 mm and a length of approximately 9 mm. The width extended in a direction perpendicular to the axial length L of the heating member 220, and the length extended in a direction parallel to the axial length L of the heating member 220.

The maximum deflection Ymax of the central portion 222 obtained by the bending test described above is used in the following Equation 1, that is, the deflection's formula, and accordingly, values representing the second moment of inertia (i.e., the second moment of area or the area moment of inertia, which describe the resistance to bending of an area) of the heating member 220 may be obtained using Equation 3.

$$Ymax=10(FL^3)/384EIx \quad \text{[Equation 1]}$$

In Equations 1, 2, and 3, Ix represents the second moment of inertia of the heating member 220, F represents the pressurizing force of the pressing member 250, L represents the axial length of the heating member 220 in the axial direction, and E represents Young's modulus of the heating member 220. At this time, the maximum deflection Ymax should be less than or equal to 0.5, so if Equation 1 is substituted into Equation 2, Equation 3 can be derived as shown below.

$$0.5 \geqq 10(FL^3)/384EIx \quad \text{[Equation 2]}$$

$$Ix \geqq 0.052(FL^3)/E \quad \text{[Equation 3]}$$

Therefore, the heating member 220 has a second moment of inertia represented by Equation 3, and thus it is possible to compensate for a decrease in the fixing efficiency due to the bending of the central portion 222.

A longitudinal section of the heating member 220 which is cut in the direction perpendicular to the axial direction, that is, both side surfaces of the fixing nip N facing the driving member 240 may have a predetermined curvature. This is because the heating member 220 has the maximum value of the second moment of inertia 1*x* that satisfies Equation 3.

A fixing operation of the fixing unit configured as described above and the image forming apparatus having the fixing unit according to aspects of the present invention will be described in detail with reference to FIGS. 2 to 4.

Referring to FIG. 2, the printing medium P is fed from the paper cassette (not shown) and passes between the transferring unit 130 and the photosensitive member 110. An exposure unit 111 (or laser scanning unit, LSU) transfers an electrostatic latent image to the photosensitive member 110, and the electrostatic latent image is developed by the developing unit 120. The developed image is then transferred to the printing medium P by the transferring unit 130 as the printing medium P passes between the photosensitive member 110 and the transferring unit 130. Although FIG. 2 illustrates the main body 100 housing four separate sets of exposure units 111, photosensitive members 110, and transferring units 130, the main body 100 may include different configurations of features. For example, one photosensitive member 110 may be provided to transfer a developed electrostatic latent image and any number of colors to the printing medium P. However, as illustrated in FIG. 2, the printing medium P repeats the above operations for the application of four colors thereto so as to produce a full color image.

As illustrated in FIG. 3, after having the developed image, comprising any number of colors, transferred to the printing medium, the printing medium P passes through the fixing nip N between the rotating member 230 and the driving member 240, and the transferred image is fixed by the application of heat and pressure from the rotating member 230 and the driving member 240. The rotating member 230 is heated by the heating member 220, which is in contact with the heat source and to which the heat is transmitted from the heat source 210, and rotates by the rotation force of the driving member 240. As described below with reference to FIG. 4, the heat source 210, the heating member 220, and the rotating member 230 are not limited thereto. The rotation of the rotating member 230 is guided by the rotation guide member 231, which supports the inner surface of the rotating member 230 such that the rotation guide member 231 prevents the rotating member 230 from meandering beyond acceptable specifications.

In the fixing unit 300 of FIG. 4, the heating member 320 to which heat is transferred from the heat source 310 by the radiant heat, by convection or thermal radiation, and the heating member 320 applies the heat to the rotating member 330. Thus, the transferred image is fixed as the printing medium P passes through the fixing nip N.

When the sides 221 of the heating member 220 are pressed by the pressing member 250 as illustrated in FIG. 6, the fixing nip N is formed so that the area of the fixing nip N may be substantially equal to the area of a region in which the heating member 220 and the driving member 240 correspond to each other through which the rotating member 230 rotates. In other words, the fixing nip N has a shape equivalent to the shape of the heating member 220, which has the form of a plate. Further, the fixing nip N is formed in a nip surface of the heating member 220 such that the nip surface of the heating member 220 is disposed to face the driving member 240 (not shown in FIG. 6). Although not shown, the sides of the heating member 320 of FIG. 4 may also be pressed by a pressing member so as to form a fixing nip N corresponding to the fixing unit 300 of FIG. 4.

The heating members 220, 320 have the second moment of inertia Ix satisfying the above Equation 3, so even if the pressing member 250 pressurizes the sides 221 of the heating members 220, 320, the maximum deflection of the central portion 222 of the heating member 220 is less than approximately 0.5 mm. Accordingly, it is possible to maintain a fixing efficiency of 90% or more in the central portion 222 of the heating members 220, 320.

As described above, according to aspects of the present invention, a heating member to which heat is transferred from a heat source is formed so that the heating member may have a predetermined width in a direction perpendicular to the axial direction of the rotating member, and accordingly it is possible to extend a width of a fixing nip. Therefore, a desired fixing quality can be obtained within rapidly, and thus high-speed operation and miniaturization can be achieved. Furthermore, a heating member has a specific second moment of inertia so that a fixing efficiency of 90% or more can be maintained, so it is possible to prevent deterioration in the fixing quality caused by applying a pressurizing force to both sides of the heating member.

Although a few aspects of the present invention have been shown and described, it would be appreciated by those skilled in the art that changes may be made without departing from the principles and spirit of the invention, the scope of which is defined in the claims and their equivalents.

What is claimed is:

1. A fixing unit, comprising:

a heating member which is heated by a heat source, the heating member having a predetermined width;

a rotating member to rotate in contact with and about the heating member;

a driving member to rotate the rotating member; and a pressing member to press both sides of the heating member towards the driving member and to form a predetermined fixing nip between the rotating member and the driving member, wherein the heating member has a second moment of inertia which is set to maintain a fixing efficiency of 90% or more in a central portion of the heating member relative to the sides of the heating member.

2. The fixing unit of claim 1, wherein the second moment of inertia satisfies the following Equation:

$$Ix \geqq 0.052(FL^3)/E \quad \text{[Equation]}$$

wherein Ix represents the second moment of inertia of the heating member; F represents the pressurizing force of the pressing member; L represents an axial direction length of the heating member; and E represents the Young's modulus of the heating member.

3. The fixing unit of claim 2, wherein a nip surface of the heating member disposed to face the driving member is bent to form a predetermined curvature.

4. The fixing unit of claim 3, wherein the nip surface is bent toward the heat source by the driving member.

5. The fixing unit of claim 1, further comprising:

a compensating member to support the heating member to prevent damage of the heat member from stress associated with heat transfer from the heat source; and a preventing member, disposed between the compensating member and the heating member, to prevent heat transfer between the heating member and the compensating member.

6. The fixing unit of claim 5, further comprising a rotation guide member disposed to guide the rotation of the rotating member about the heating member and through the predetermined fixing nip.

7. The fixing unit of claim 5, wherein the heat source contacts the heating member.

8. The fixing unit of claim 7, further comprising an elastic member to elastically press the heat source towards the heating member disposed between the heat source and the preventing member.

9. The fixing unit of claim 5, wherein the heat source is spaced apart from the heating member by a predetermined distance.

10. The fixing unit of claim 9, wherein an inner surface of the heating member facing the heating source is black.

11. The fixing unit of claim 1, further comprising a thermal conductive resin disposed between the heat source and the heating member.

12. The fixing unit of claim 1, wherein the rotating member rotates through the predetermined fixing nip.

13. The fixing unit of claim 1, wherein a temperature of the predetermined fixing nip increases to a fixing temperature from an ambient temperature in less than about 5 seconds.

14. The fixing unit of claim 13, wherein the fixing temperature is about 150° C.

15. The fixing unit of claim 1, wherein a temperature of the predetermined fixing nip increases to a fixing temperature from an ambient temperature in less than about 3 seconds.

16. The fixing unit of claim 1, wherein the heat source heats a temperature of the predetermined fixing nip at a rate greater than about 30° C./s.

17. The fixing unit of claim 16, wherein the heat source heats the temperature of the predetermined fixing nip at a rate greater than about 62.5° C./s.

18. A fixing unit, comprising:

a heating member which is heated by a heat source, the heating member having a predetermined width;

a rotating member to rotate in contact with and about the heating member;

a driving member to rotate the rotating member; and a pressing member to press both sides of the heating member towards the driving member and to form a predetermined fixing nip between the rotating member and the driving member, wherein a maximum deflection of a central portion of the heating member is less than approximately 0.5 mm, and wherein the heating member has a second moment of inertia which is set to maintain a fixing efficiency of 90% or more in the central portion of the heating member relative to the sides of the heating member.

19. An image forming apparatus, comprising:

a main body;

at least one photosensitive member on which an electrostatic latent image is formed;

at least one developing unit to develop the electrostatic latent image;

at least one transferring unit to transfer the developed image to a printing medium; and a fixing unit to fix the transferred image onto the printing medium;

wherein the fixing unit comprises:

a heating member which is heated by a heat source, the heating member having a predetermined width and a second moment of inertia to maintain a fixing efficiency of 90% or more in a central portion of the heating member, a rotating member to rotate in contact with and about the heating member, a driving member to rotate the rotating member, and a pressing member to press both sides of the heating member towards the driving member and to form a predetermined fixing nip between the rotating member and the driving member.

20. The image forming apparatus of claim 19, wherein the second moment of inertia satisfies the following Equation:

$$Ix \geqq 0.052(FL^3)/E \quad \text{[Equation]}$$

wherein Ix represents the second moment of inertia of the heating member; F represents the pressurizing force of the pressing member; L represents an axial direction length of the heating member; and E represents the Young's modulus of the heating member.

21. The image forming apparatus of claim 20, wherein a nip surface of the heating member disposed to face the driving member is bent to form a predetermined curvature.

22. The image forming apparatus of claim 19, further comprising:

a compensating member to support the heating member to prevent damage of the heat member from stress associated with heat transfer from the heat source; and a preventing member, which disposed between the compensating member and the heating member, to prevent heat transfer between the heating member and the compensating member.

23. The image forming apparatus of claim 22, further comprising a rotation guide member disposed to guide the rotation of the rotating member about the heating member and through the predetermined fixing nip.

24. The image forming apparatus of claim 22, wherein the heat source contacts the heating member.

25. The image forming apparatus of claim 24, further comprising an elastic member to elastically press the heat source towards the heating member disposed between the heat source and the preventing member.

26. The image forming apparatus of claim 25, further comprising a thermal conductive resin disposed between the heat source and the heating member.

27. The image forming apparatus of claim 22, wherein the heat source is spaced apart from the heating member by a predetermined distance.

28. The image forming apparatus of claim 27, wherein an inner surface of the heating member facing the heating source is black.

29. A fusing unit, comprising:

a heating member which is heated by a heat source, the heating member having a predetermined width;

a rotating member to rotate in contact with and about the heating member; and a driving member to rotate the rotating member, wherein at least one of the heating member and the driving member is pressed toward the other of the heating member and the driving member to form a predetermined fixing nip between the rotating member and the driving member, and the heating member has a second moment of inertia which is set to maintain a fixing efficiency of 90% or more in a central portion of the heating member.

* * * * *